US006123627A

United States Patent [19]

Antonious

[11] Patent Number: 6,123,627

[45] **Date of Patent: *Sep. 26, 2000**

[54] GOLF CLUB HEAD WITH REINFORCING OUTER SUPPORT SYSTEM HAVING WEIGHT INSERTS

[76] Inventor: Anthony J. Antonious, 7738 Calle Facil, Sarasota, Fla. 34238

[ * ] Notice: This patent is subject to a terminal disclaimer.

[21] Appl. No.: 09/229,448

[22] Filed: Jan. 13, 1999

Related U.S. Application Data

[63] Continuation-in-part of application No. 09/081,948, May 21, 1998, Pat. No. 5,989,134.

[51] Int. Cl.[7] ..... A63B 53/04

[52] U.S. Cl. ..... 473/327; 473/328; 473/335; 473/345; 473/349

[58] Field of Search ..... 473/324–350, 473/226, 228, 227, 256; D21/733–755

[56] References Cited

U.S. PATENT DOCUMENTS

| | | |
|---|---|---|
| 3,761,095 | 9/1973 | Thompson . |
| 5,154,423 | 10/1992 | Antonious . |
| 5,314,185 | 5/1994 | Gorman . |
| 5,465,970 | 11/1995 | Adams . |
| 5,584,770 | 12/1996 | Jensen . |
| 5,735,754 | 4/1998 | Antonious . |
| 5,766,095 | 6/1998 | Antonious . |
| 5,954,595 | 9/1999 | Antonious . |
| 5,989,134 | 11/1999 | Antonious . |

*Primary Examiner*—Sebastiano Passaniti
*Attorney, Agent, or Firm*—Aquilino, Welsh & Flaxman

[57] ABSTRACT

A metalwood type golf club head is disclosed including an reinforcing outer support band which provides additional strength and mass on outer surfaces of the club head and further includes an elongated weighted insert formed with said reinforcing band to add additional weight to outer peripheral surfaces of the club head.

14 Claims, 8 Drawing Sheets

FIG. 1
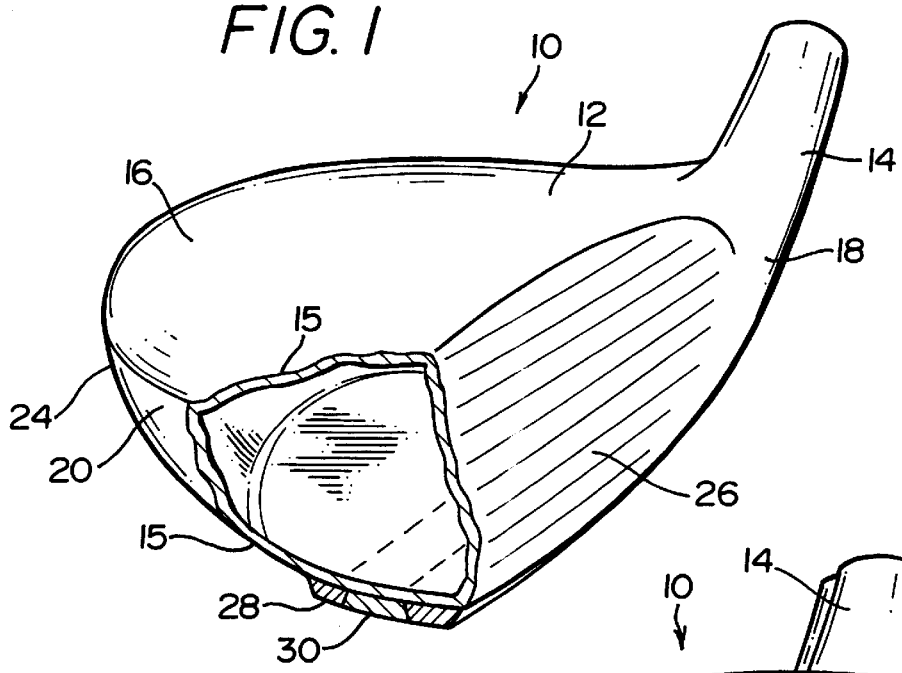
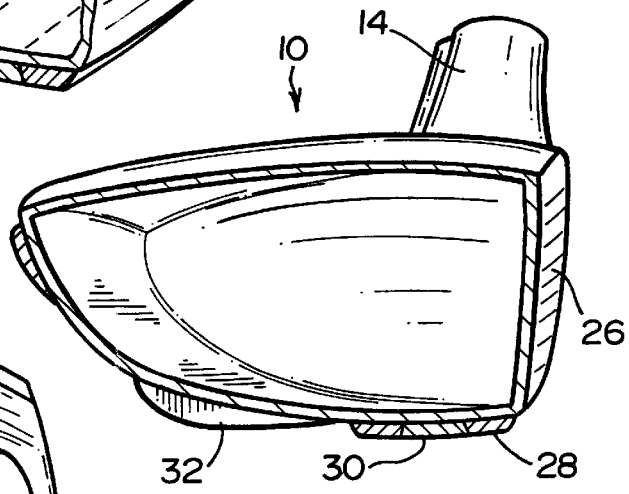
FIG. 2
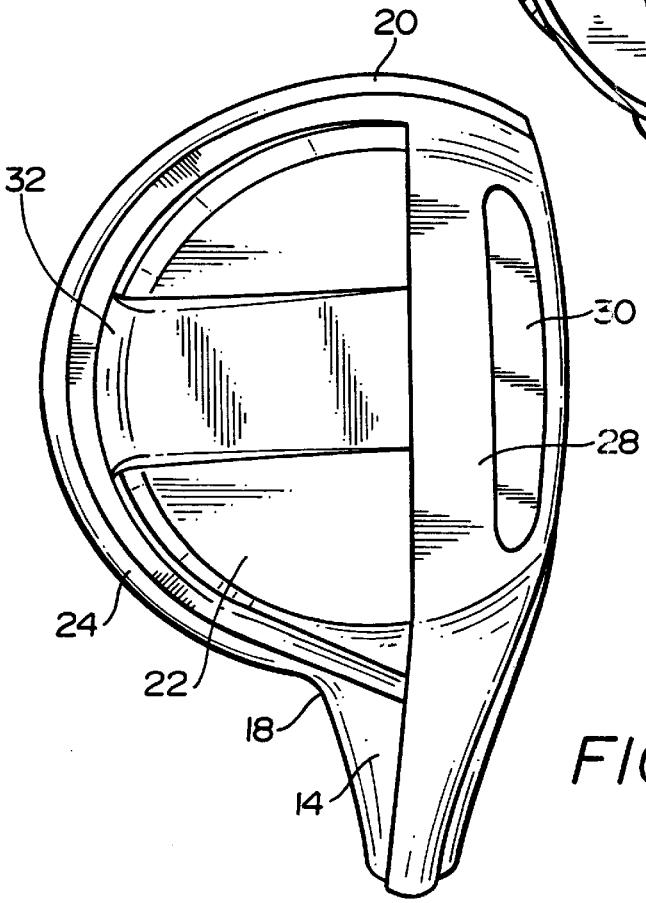
FIG. 3

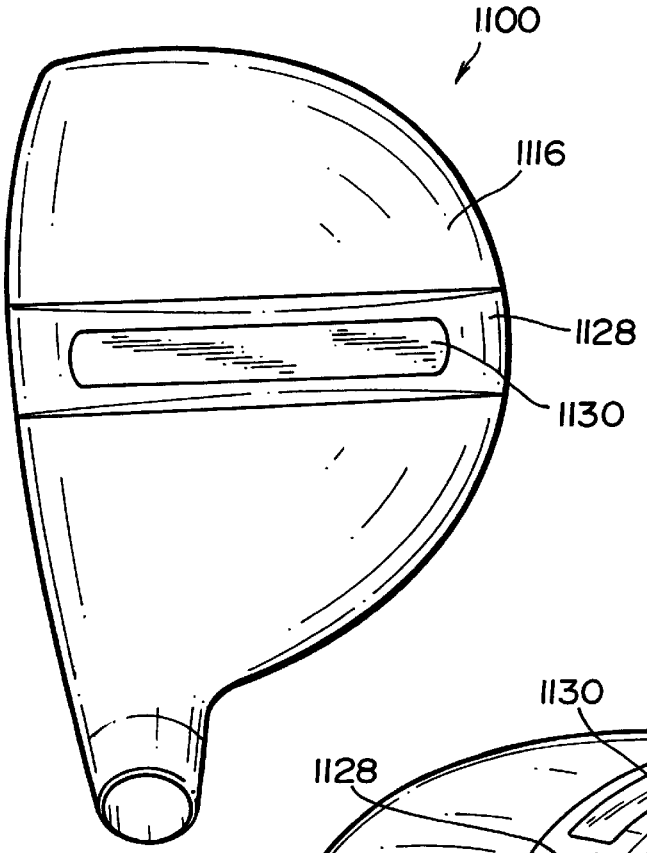
FIG. 15
FIG. 16
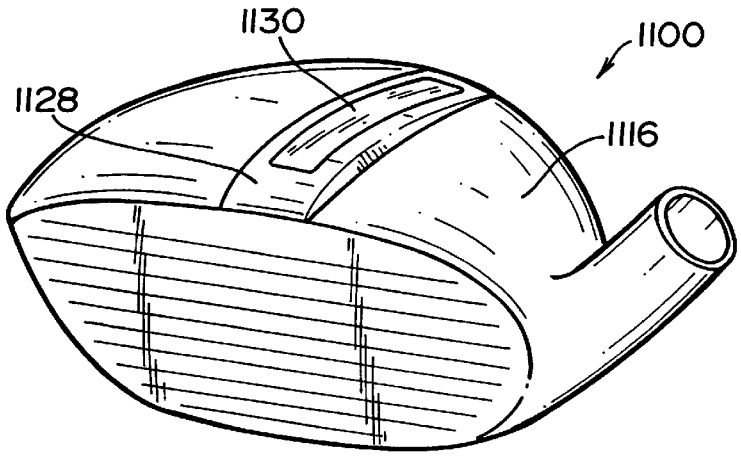
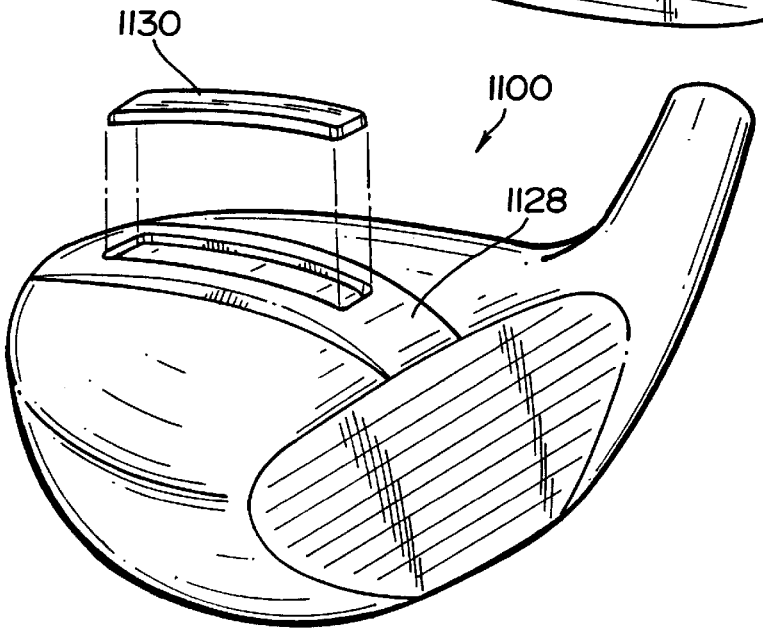
FIG. 17

GOLF CLUB HEAD WITH REINFORCING OUTER SUPPORT SYSTEM HAVING WEIGHT INSERTS

The present invention is a continuation-in-part of Ser. No. 09/081,948, filed May 21, 1998 now U.S. Pat. No. 5,989,134.

BACKGROUND AND SUMMARY OF THE INVENTION

The present invention relates to golf club heads and, in particular, to metalwood heads having an improved outer reinforcing and weighting system. In my prior U.S. Patent application, I described a golf club head having a reinforcing outer support system for a metalwood type golf club head formed of various embodiments using reinforcing band-like or bracing on the outer peripheral surfaces of the club head. The reinforcing outer support members extend along the bottom surface, the side surfaces and top surfaces of the club head in various configurations and combinations allowing the club head to be made of thinner and lighter materials while maintaining the strength and integrity necessary to overcome the impact and torsional forces experienced when the club head strikes a golf ball at speeds in excess of 100 miles per hour.

In addition, it has been recently recognized that lowering or locating more weight closer to the bottom of a golf club head advantageously lowers the center of gravity, and makes it easier for a golf ball to be played from difficult lies that are encountered on the golf course while playing a game of golf. To this end, there are a number of golf clubs currently being sold in the commercial market which recognize and address this problem. A specific golf club of this type has an inverted club head structure with the bottom of the club head being larger than the top in an upright trapezoidal shape. Another club head recognizing this problem incorporates tungsten weights recessed into the bottom of the club head to lower the center of gravity. Still another golf club head includes a weighted disc located on an inner bottom surface of the metal shell forming the club head to lower the center of gravity.

The present invention relates to improvement of a metalwood golf club head having at least one reinforcing outer support member which may be combined with heavy metal weighted inserts retained in the outer support member, located on and extending beyond the outer surface of the club head. This specifically locates a substantial portion of the overall weight of the club head, at its lowermost position, moving the center of gravity toward the weighted insert, making it easier for the golf club head to be used to hit golf shots with specific shot configurations. Preferably, the reinforcing member and insert attached thereto, is located beyond the bottom surface of the club head thereby shifting the center of gravity downwardly to an extreme lowermost position, making it easier to hit a golf ball from difficult lies when playing a game of golf.

The increased weight difference of heavy metals to steel, precisely located behind and adjacent the ball striking area on the club face, permits a greater transfer of energy, at impact. Having this much heavier tungsten insert, located behind and parallel to the lower portion of the club face, greatly increases club head feel, stability and accuracy. However, also adding tungsten inserts to the auxiliary sole members, located in a perpendicular direction to the club face, provides the optimum performance results. Adverse torqueing, twisting and "knock-back", are incredibly unaffected when off-center ball contact occurs, on the club face. Balls travel straighter, farther with hardly any noticeable diminishing or negative effect from strong crosswinds or head winds when encountered in the direction of the intended targeted ball-flight.

One embodiment of the heavy metal tungsten inserts, is located parallel to and practically across the entire back of and lower portion of the club face. This provides the additional heavier mass required to off-set any negative effects from "thin shots" or "off-center" ball contacts, anywhere on the club face. Since the heavy metal tungsten inserts are located and contained in the raised reinforcing outer sole members, the significant weight mass extends beyond the bottom surface of the club head. This design creates golf club heads having the lowest possible center of gravity construction which is most advantageous for club heads such as drivers, fairway woods or utility clubs.

The reinforcing outer support members, located on the outer walls, uniquely surround the club head to provide a formidable bracing structure, not found in any prior art club heads. The support members are also very versatile. They may be hollow, solid or partially filled. They may also retain a heavy metal insert. They may be raised flat, band-shaped members, with rounded, curved or other desired outer shaped surfaces.

One of the most significant features of this invention is the capability to locate the reinforced outer support members at the extreme outermost surfaces of the club head. This not only provides a formidable bracing support system for the overall club head, but also locates and distributes substantial mass, beyond the outer sidewalls, bottom and top surface or crown of the club head. This produces a club head with high-tech built-in features that dramatically resist the adverse affects from "torqueing" and twisting when "square ball contact" is not made. In addition, a much larger "sweet-spot" is created on a "club face of an average size" metalwood club head. This accounts for the unusual solidness and superior feel, impacting a golf ball, even for "off center" hits--the balls go straighter and farther, even from the toughest lies, such as thick grass, rough and bunkers. Needless to say, this is most appreciated particularly during play in severe, adverse weather conditions. The reinforcing outer support system is a very gratifying, practical innovation that helps produce the best performance possible, from all calibers of golfers.

In a primary embodiment of the present invention, a metalwood golf club head including a hosel and club head body having an upper surface, lower surface, heel, toe, side surfaces and ball striking face, is provided with at least a lower reinforced outer support member extending in a front to rear direction and located on and extending beyond the bottom surface of the club head. The lower support member further includes at least a cavity or depression into which heavy metal tungsten or other similar weights can be inserted. The weights are positioned longitudinally with respect to the support members and which may be located parallel to the club face or may also extend from the club face in a front to rear direction. Because the lower support member and the additional tungsten weights are proportionately heavier with respect to the overall weight of the club head, the center of gravity of the golf club head is lowered considerably to achieve improved overall performance.

Among the objects of the present invention is the provision of a metalwood type golf club head having a lower raised reinforced outer support member located beyond the bottom surface of the club head and an improved weight configuration to lower the center of gravity.

Another object of the invention is the provision of a metalwood type golf club head, specifically designed to maximize the performance of golf balls hit from difficult lies encountered during the playing of a round of golf.

Another object of the invention is the provision of a metalwood type golf club head, in which weight and reinforcing members may be added on the bottom, top, and side surfaces of the club head.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 1 is a front elevational view of a metalwood type golf club in accordance with the present invention.

FIG. 2 is a bottom view thereof.

FIG. 3 is a side sectional view taken along the lines 3—3 of FIG. 2.

FIG. 15 is a top plan view of an eleventh embodiment in accordance with the present invention.

FIG. 16 is a front perspective view of the embodiment of FIG. 15.

FIG. 17 is an exploded view of the embodiment of FIG. 15.

DESCRIPTION OF THE PREFERRED EMBODIMENTS

Figure 4:
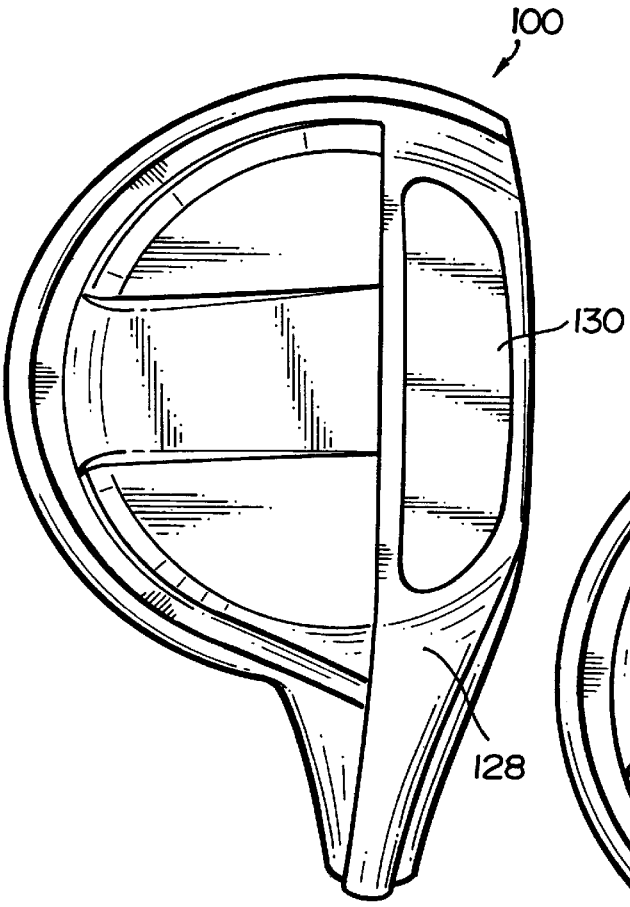
FIG. 4 is a bottom view of a second embodiment in accordance with the present invention.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Referring to the drawings, FIGS. 1–3 show an improved golf club head 10 in accordance with the present invention which includes a club head body 12 and a hosel 14. In this preferred embodiment, the club head body 12 is formed of a metal shell 15 having a hollow or filled interior commonly known in the golf industry as a metalwood. The club head body includes an upper surface 16, heel 18, toe 20, lower surface 22, side surfaces 24 and ball striking face 26. The club head 10 includes a lower reinforcing band member 28 which is located parallel to the ball striking face 26 and extends from the toe 20 to the heel 18 and up onto the hosel 14. The support band 28 includes a heavy metal insert 30 which is also generally parallel to the reinforcing band member 28. The insert 30, preferably tungsten, adds additional weight to the bottom of the club head. The bottom 22 of the club head 10 includes an outwardly projecting skimmer 32 extending rearwardly from the reinforcing band member 28.

FIG. 4 illustrates a second embodiment of a golf club head 100 in accordance with the present invention. This embodiment is identical to the golf club head described with reference to FIGS. 1 and 3, except that the insert 130 is wider and preferably thicker than the insert shown in the first embodiment extending more than half the distance of the width of a support band 128 located on the club head 100.

Figure 5:
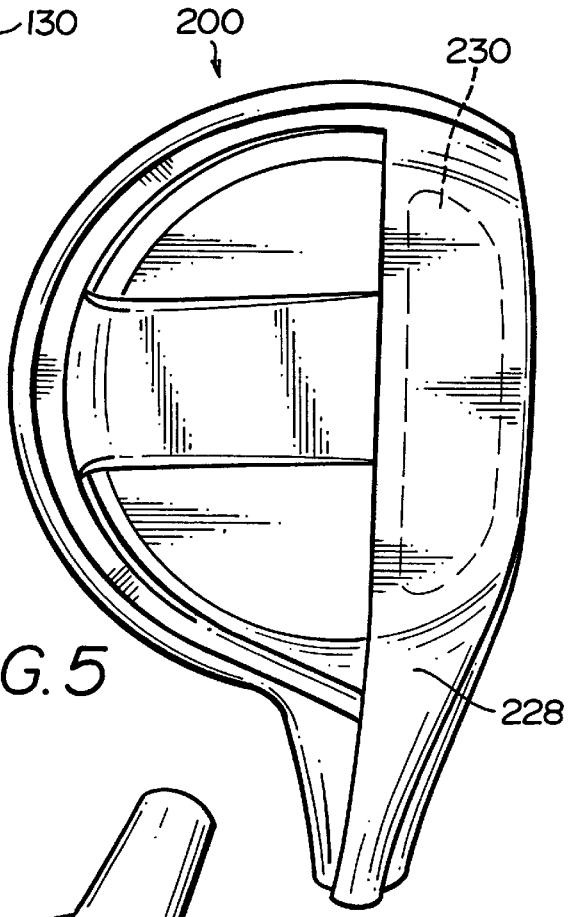
FIG. 5 is a bottom view of third embodiment in accordance with the present invention.
Figure 6:
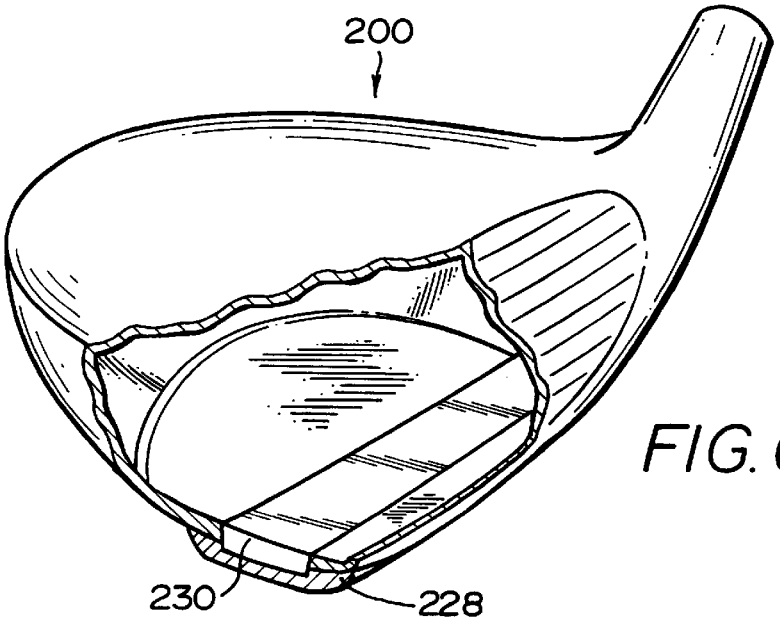
FIG. 6 is a sectional view taken along the lines 5—5 of FIG. 5.

FIGS. 5 and 6 show a third embodiment of a golf club head 200 in accordance with the present invention. This embodiment is similar to the embodiments of FIGS. 1–3 and 4, except that an insert 230 is located in the interior of the club 200, behind reinforcing band member 228, as can be seen in the sectional view of FIG. 6.

Figure 7:
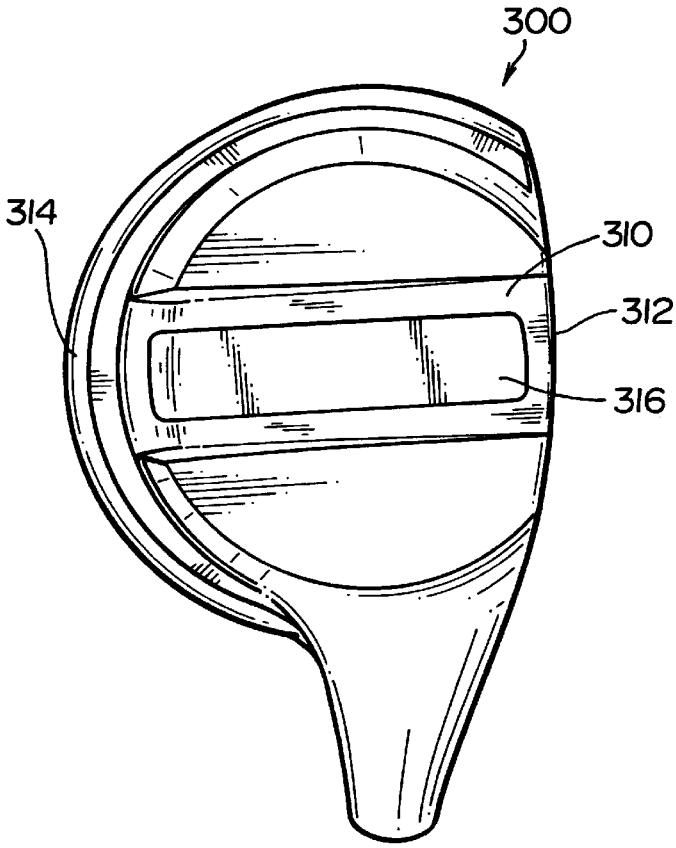
FIG. 7 is a bottom view of a fourth embodiment in accordance with the present invention.

FIG. 7 shows a forth embodiment of a golf club head 300 including a single reinforcing outer sole member 310 extending from behind the ball striking face 312 to the rear surface 314 and includes a weight insert 316 of heavy metal material such as tungsten which is positioned generally perpendicular to the ball striking face 312 in a front to rear direction.

Figure 8:
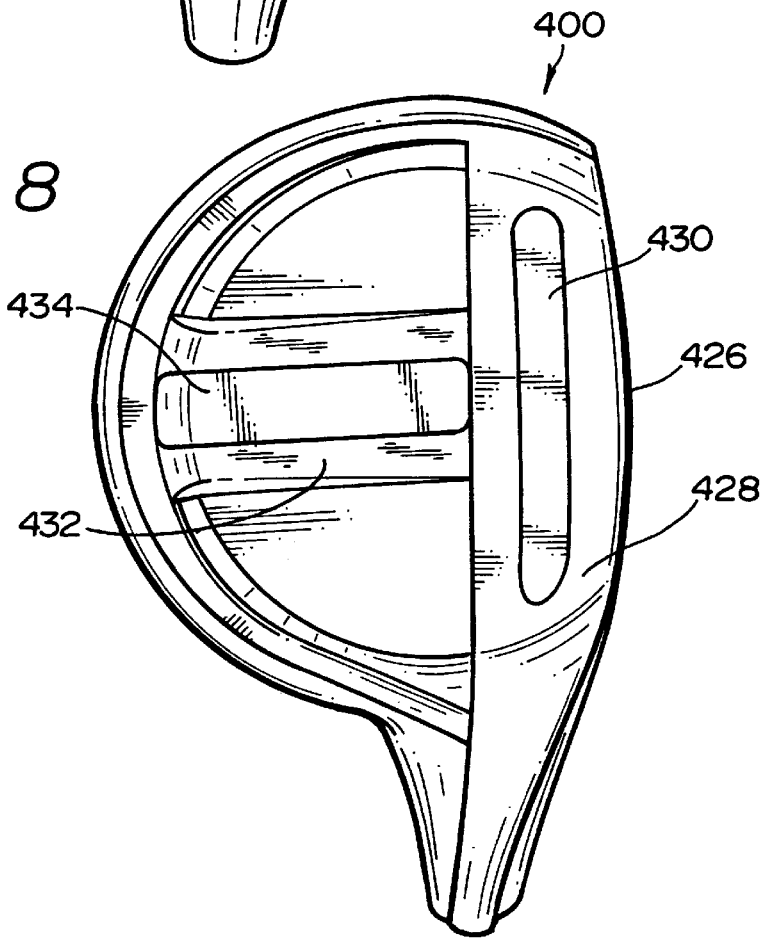
FIG. 8 is a bottom perspective and exploded view of the club head of FIG. 7.

FIG. 8 shows a fifth embodiment of a golf club head 400 including a reinforcing outer band member 428 having a weighted insert 430 generally parallel to the ball striking face 426 and a second reinforcing band member 432 having an insert 434 extending in a front to rear direction perpendicular to the first insert 430 and ball striking face 426.

Figure 9:
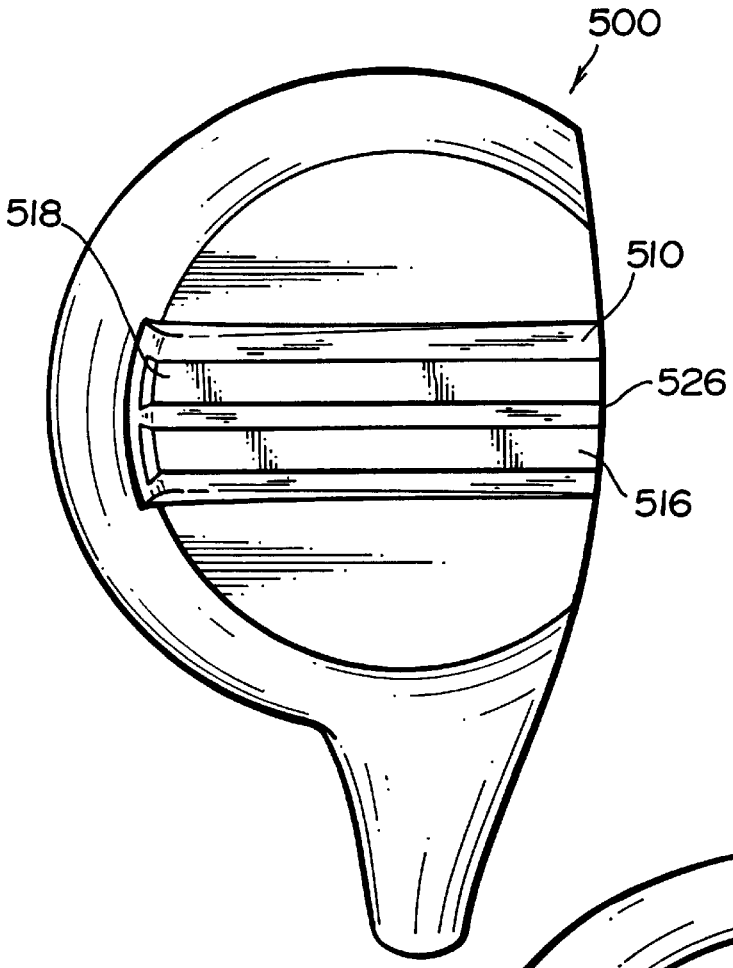
FIG. 9 is a bottom view of a fifth embodiment in accordance with the present invention.

FIG. 9 shows a sixth embodiment of a golf club head 500 which includes a reinforcing outer support band member 510 extending in a front to rear direction perpendicular to the ball striking face 526 and includes inserts 516 and 518 which also extend in a front to rear direction and perpendicular to the ball striking face 526.

Figure 10:
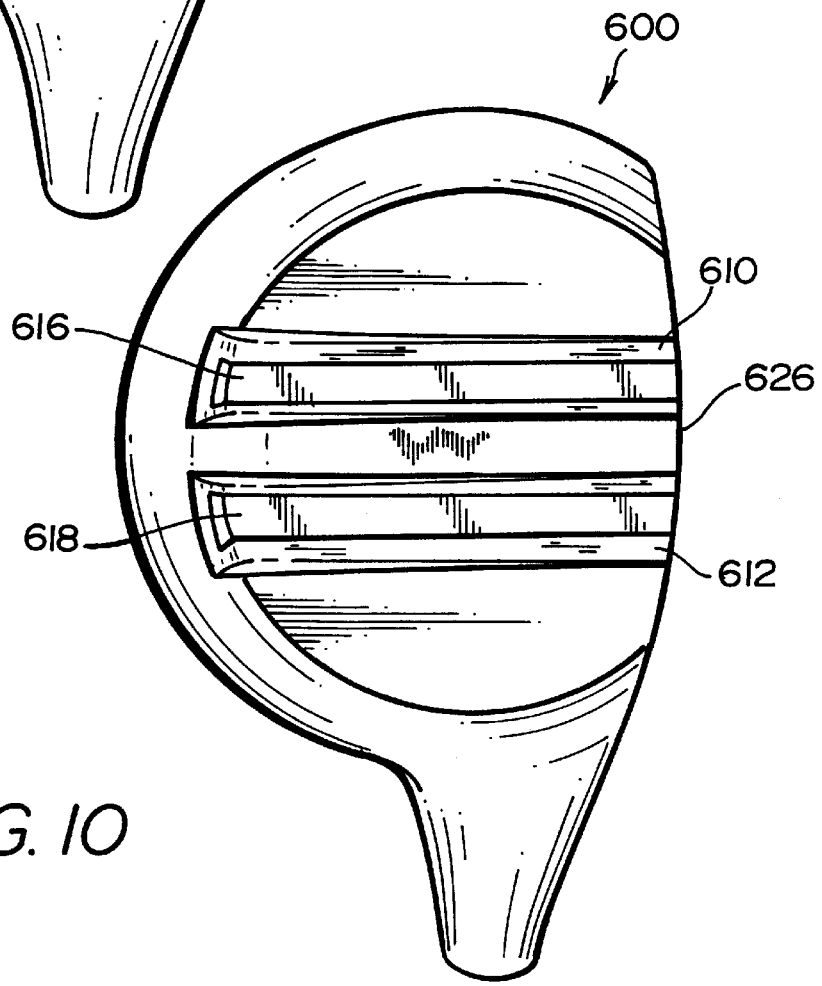
FIG. 10 is a bottom view of a sixth embodiment in accordance with the present invention.

FIG. 10 shows a sixth embodiment of a golf club head 600 which includes a pair of reinforcing outer sole members 610 and 612 extending in a front to rear direction perpendicular to the ball striking face 626 and includes inserts 616 and 618 which also extend in a front to rear direction and perpendicular to the ball striking face 626.

The weight members preferably are made of tungsten or other heavy material whereby the overall weight and center of gravity of the club head is shifted downwardly toward the bottom surface as a result of locating the support bands and weight members in this area.

Figure 11:
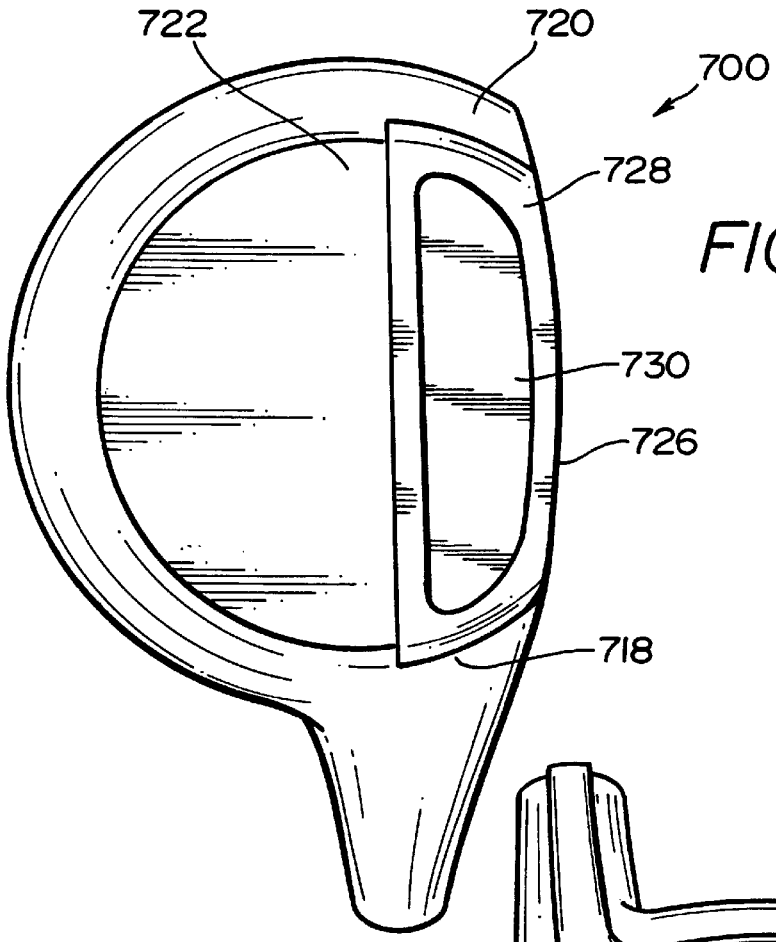
FIG. 11 is a bottom view of a seventh embodiment in accordance with the present invention.

FIG. 11 shows a seventh embodiment of a golf club head 700 in accordance with the present invention including a single outer support band 728 located on the bottom 722 of the club head 700 and extending only between the heel 718 and toe 720. The support band member 728 includes an insert 730 located generally parallel to the club face 726.

Figure 12:
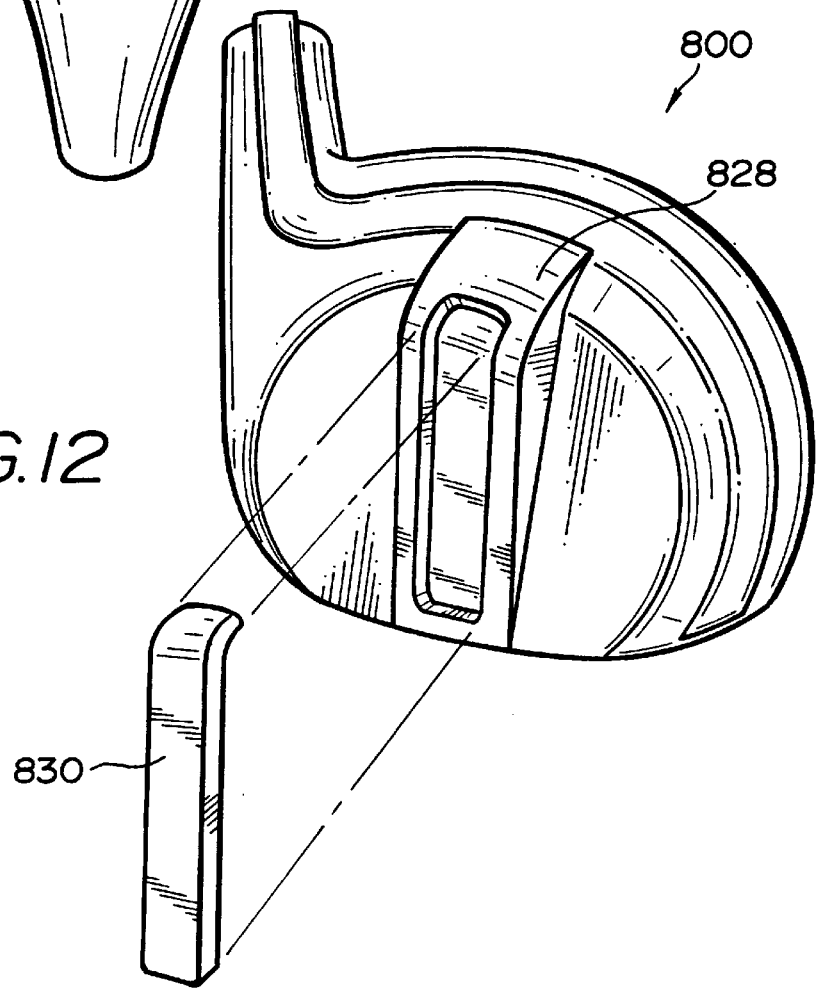
FIG. 12 is a bottom perspective view of an eighth embodiment in accordance with the present invention.

FIG. 12 shows an eighth embodiment of a golf club head 800 including a skimmer shaped reinforcing band member 828 having a tungsten insert 830 shaped to conform with the outer dimensions of the skimmer.

Figure 13:
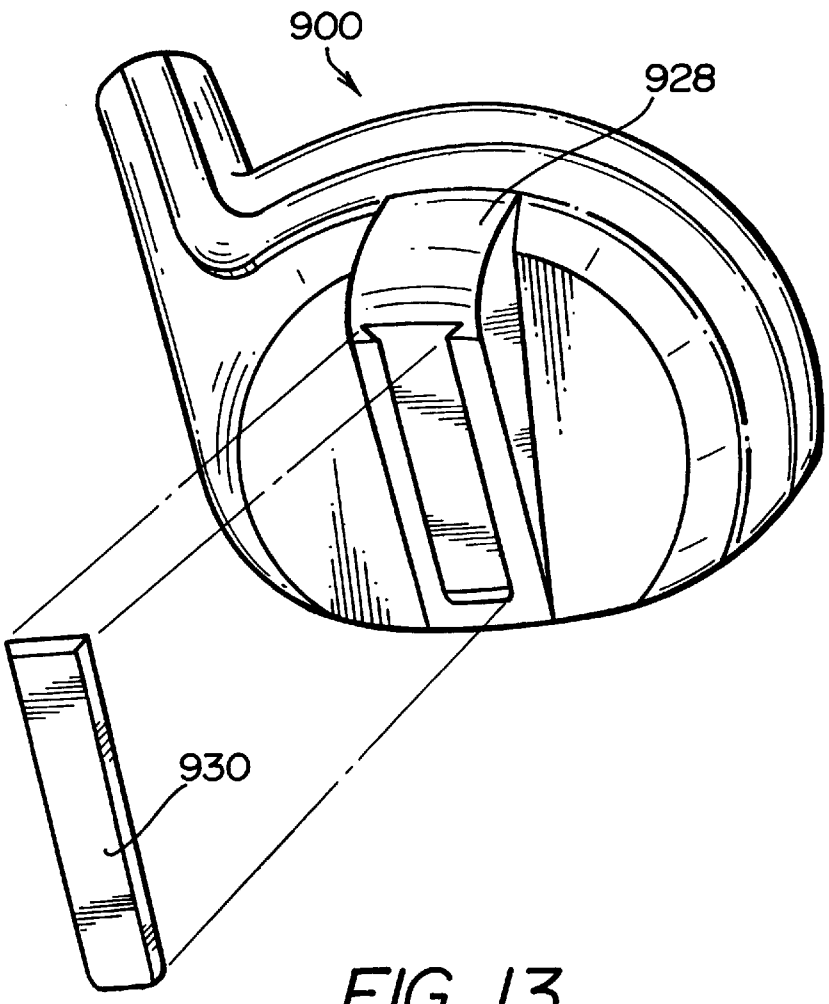
FIG. 13 is a bottom perspective view of a ninth embodiment in accordance with the present invention.

FIG. 13 shows a ninth embodiment of a golf club head 900 including a skimmer shaped reinforcing band member 928 having an insert 930.

Figure 14:
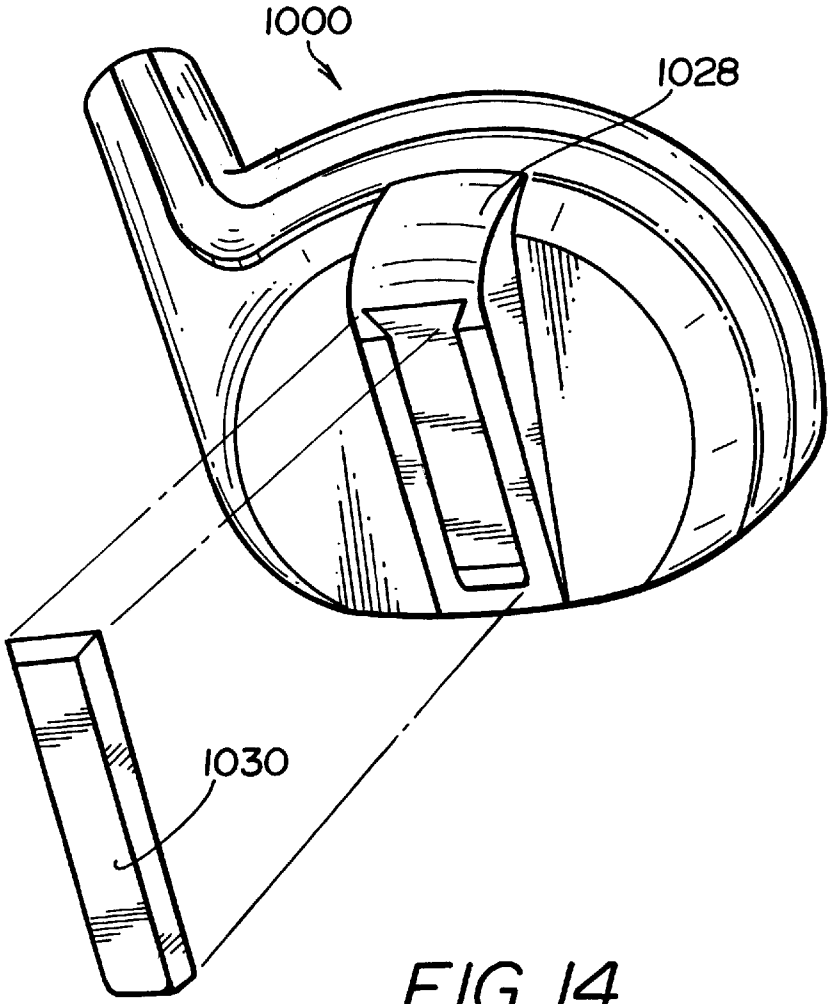
FIG. 14 is a bottom view of a tenth embodiment in accordance with the present invention.

FIG. 14 shows a tenth embodiment of a golf club head 1000 in accordance with the present invention including a skimmer shaped reinforcing member 1028 having a thicker tungsten insert 1030.

FIGS. 15, 16 and 17 show an eleventh embodiment of a golf club head 1100 having a single reinforcing band member 1128 formed on the top surface or crown 1116 including an insert 1130.

Figure 18:
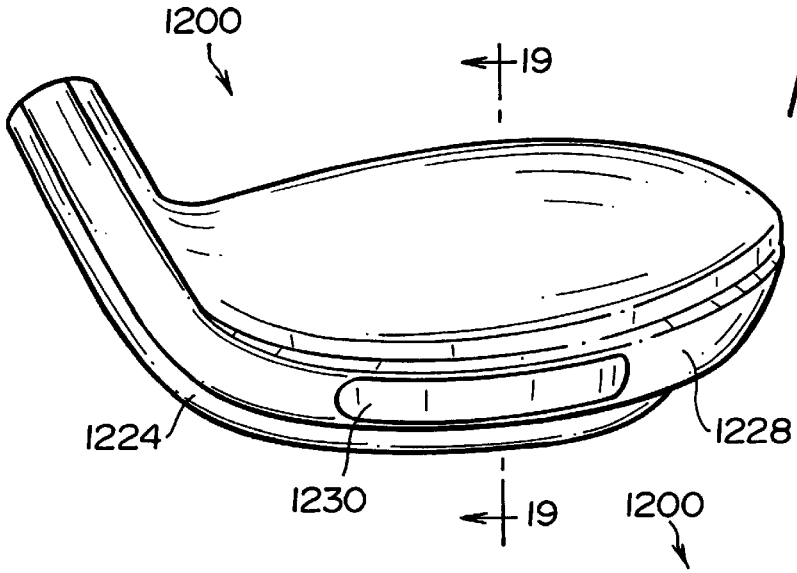
FIG. 18 is a rear elevational view of a twelfth embodiment in accordance with the present invention.
Figure 19:
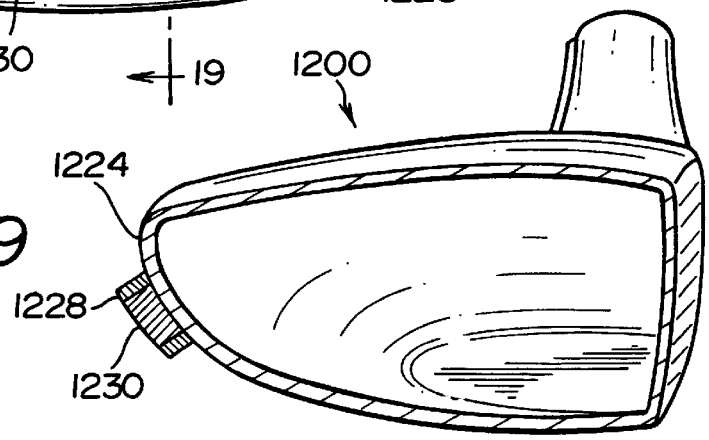
FIG. 19 is an end sectional view taken along the lines 19—19 of FIG. 18.

FIGS. 18 and 19 show a twelfth embodiment of a golf club head 1200 having a single reinforcing band member 1228 located on a rear surface 1224 which extends from the toe section 1220 to the heel section 1218. The reinforcing band member 1228 includes a tungsten insert 1230 centrally located at the rear of the club head 1200.

Figure 20:
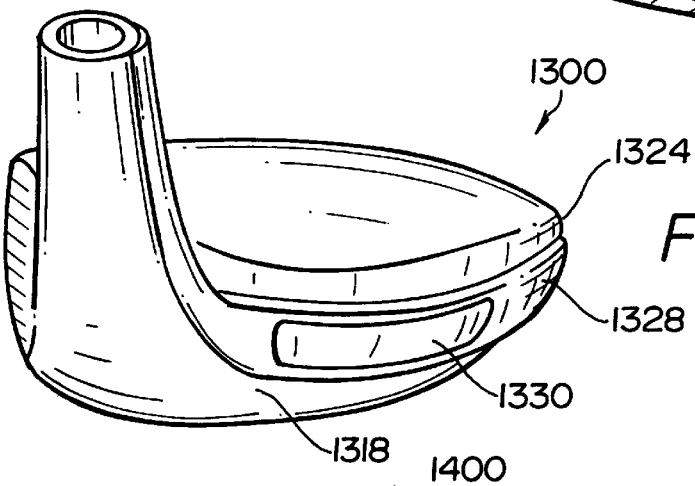
FIG. 20 is a side elevational view of a thirteenth embodiment in accordance with the present invention.

FIG. 20 shows a thirteenth embodiment of a golf club head 1300 having a single reinforcing band member 1328 located on a rear surface 1324 which extends from the toe section (not shown) to the heel section 1318. The reinforcing band member 1328 includes a tungsten insert 1330 located adjacent the heel section 1318 for golfers needing more weight at the heel of the club head 1300.

Figure 21:
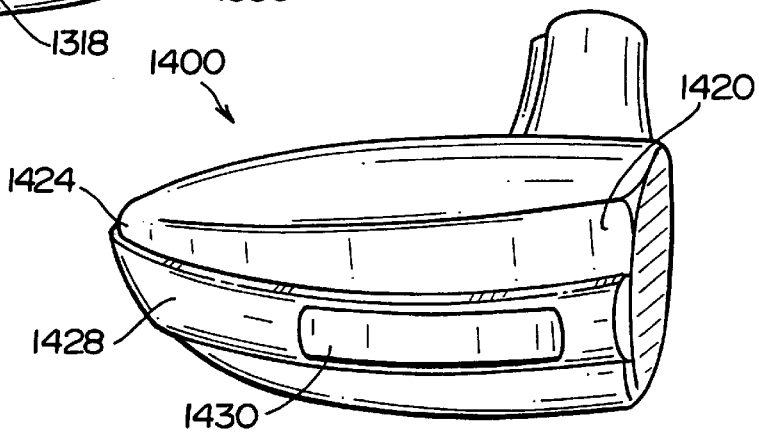
FIG. 21 is a side elevational view of a fourteenth embodiment in accordance with the present invention.

FIG. 21 shows a fourteenth embodiment of a golf club head 1400 having a single reinforcing band member 1428 located on a rear surface 1424 which extends from the toe section 1420 to the heel section (not shown). The reinforcing band member 1428 includes a tungsten insert 1430 located toward the toe section 1420 for golfers who need more weight at the toe of the club head 1400.

While various preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A metalwood type golf club head including a hosel, a club head body having a heel, toe, bottom surface, top surface, side wall surfaces, rear surface and ball striking face wherein the improvement comprises:

at least one elongated, reinforcing outer support band located on an outer surface of said club head body and extending outwardly from said outer surface of said club head body, said support band further including at least one elongated weighted insert which is generally parallel to and confined within said support band.

2. The golf club head of claim 1, wherein said reinforcing outer support band is located on said bottom surface and extends between said heel and said toe adjacent to and generally parallel to said ball striking face.

3. The golf club head of claim 1, wherein said reinforcing outer support band is located on said bottom surface and extends in a front to rear direction, generally perpendicular to said ball striking face.

4. The golf club head of claim 1, said reinforcing outer band including a first reinforcing outer support band located on said bottom surface in a heel to toe direction generally parallel to said ball striking face, and a second reinforcing outer support band on said bottom surface located in a front to rear direction generally perpendicular to said ball striking face; said weighted insert being in at least one of said support bands.

5. The golf club head of claim 3, wherein said reinforcing outer support band includes two parallel weighted inserts; said inserts being disposed in a front to rear direction and generally perpendicular to said ball striking face.

6. The golf club head of claim 1, including a pair of reinforcing outer support bands located on said bottom surface in a front to rear direction generally perpendicular to said ball striking face; each of said reinforcing bands including a weighted insert extending in a front to rear direction.

7. The golf club head of claim 1, wherein said reinforcing outer support band includes an outer surface and said insert is coincident with said outer surface.

8. The golf club head of claim 1, wherein said reinforcing outer support band includes an outer surface and said insert is formed interiorly of said outer surface.

9. The golf club head of claim 1, wherein said reinforcing outer support band is located on a top surface of said club head and extends in a front to rear direction and is generally perpendicular to said ball striking face.

10. The golf club head of claim 1, wherein said reinforcing outer support band extends along said rear surface and said side surfaces of said club head in a heel to toe direction and said insert is parallel to said support band.

11. The golf club head of claim 10 wherein said insert is located on said rear surface.

12. The golf club head of claim 10 wherein said insert is located on said side surface adjacent said toe.

13. The golf club head of claim 10 wherein said insert is located on said side surface adjacent said heel.

14. A metalwood type golf club head including a hosel, a club head body having a heel, toe, bottom surface, top surface, side wall surfaces, rear surface and ball striking face wherein the improvement comprises:

a ground engaging skimmer on said bottom surface extending in a front to rear direction; said skimmer extending upwardly and rearwardly and further including a weighted insert extending in a front to rear direction on said skimmer.

* * * * *